US007762062B2

(12) United States Patent
Opris

(10) Patent No.: US 7,762,062 B2
(45) Date of Patent: Jul. 27, 2010

(54) ADAPTIVE REGENERATION SYSTEM

(75) Inventor: Cornelius Nicolae Opris, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 1139 days.

(21) Appl. No.: 11/045,295

(22) Filed: Jan. 31, 2005

(65) Prior Publication Data

US 2006/0168952 A1 Aug. 3, 2006

(51) Int. Cl.
*F01N 3/00* (2006.01)

(52) U.S. Cl. ..... 60/295; 60/274; 60/297; 60/300

(58) Field of Classification Search ..... 60/274, 60/277, 295, 297, 300, 303, 311; 55/282.3, 55/283, 284, DIG. 10, DIG. 30
See application file for complete search history.

(56) References Cited

U.S. PATENT DOCUMENTS 4,505,107 A * 3/1985 Yamaguchi et al. ..... 60/303
5,171,337 A * 12/1992 Pollock ..... 55/284
5,265,418 A * 11/1993 Smith ..... 60/284
6,090,172 A * 7/2000 Dementhon et al. ..... 55/282.3
6,422,001 B1 7/2002 Sherman et al.
6,865,883 B2 * 3/2005 Gomulka ..... 60/295
6,912,848 B2 * 7/2005 Bedapudi ..... 60/297
6,959,541 B2 * 11/2005 Kosaka et al. ..... 60/295
7,076,945 B2 * 7/2006 Sisken et al. ..... 60/295
7,159,384 B2 * 1/2007 Otake et al. ..... 60/277
7,174,708 B2 * 2/2007 Bardon et al. ..... 60/303
2002/0112472 A1 8/2002 Tashiro et al.

FOREIGN PATENT DOCUMENTS

EP 1234959 A2 8/2002
JP 2000-234509 8/2000
JP 2002-242660 8/2002

OTHER PUBLICATIONS

C. Opris et al., "A 2-D Computational Model Describing The Flow and Filtration Characteristics of a Ceramic Diesel Particulate Trap", SAE—980545, Published Feb. 1998.

* cited by examiner

*Primary Examiner*—Tu M Nguyen
(74) *Attorney, Agent, or Firm*—Finnegan, Hendersaon, Farabow, Garrett & Dunner

(57) ABSTRACT

A regeneration system for a work machine may include a power source configured to provide a variable power output. The regeneration system may also include at least one regeneration device operably connected to the power source and adapted to use at least a portion of the variable power output to regenerate the exhaust element. A controller may be configured to determine an amount of power required to regenerate the exhaust element. The controller may also be configured to adjust operation of the power source based on the amount of power required to regenerate the exhaust element.

25 Claims, 3 Drawing Sheets

ADAPTIVE REGENERATION SYSTEM

TECHNICAL FIELD

The present disclosure is directed to regeneration of exhaust system components and, more particularly, to systems and methods for regenerating exhaust system components based on an amount of power needed for regeneration.

BACKGROUND

Engines including diesel engines, gasoline engines, natural gas engines, and other engines in the art, may exhaust air pollutants. The air pollutants may be composed of gaseous and solid materials, which include particulate matter. Particulate matter may include unburned carbon particles called soot. In addition, particulate matter may also contain ash, which can be used in engine oils to reduce the acidity of the oil.

The particulate matter generated may be filtered from an exhaust stream. Various technologies may be used to filter particulate matter from an exhaust stream. One of these technologies includes the use of an exhaust element, such as a particulate filter. Particulate filters trap particles contained in the exhaust stream, so the exhaust stream is cleaner when it enters the air as compared to when it exited from the engine. There exist various types of particulate filters in the art. Some filters may include porous filter material or, alternatively, some filters may use wire meshes. The pores or the wire meshes may trap the particulate mater in the exhaust stream as the exhaust stream flows from the input to the output of the filter.

Particulate matter trapped by the filter may eventually clog the filter and reduce the operating efficiency of the engine. As the filter gets clogged, the back pressure to the engine increases. Therefore, the engine may consume more fuel to produce the same amount of power as compared to when the filter is not clogged.

These and other problems may be avoided by periodic cleaning of the filter. Various methods of cleaning filters exist in the art. One method of cleaning the filter is to heat the particulate matter to a temperature at which it combusts or vaporizes. This type of filter cleaning may also be termed as regeneration.

Various regeneration systems have been proposed to regenerate an exhaust element. Many of these systems involve raising the temperature in the exhaust element to aid in regeneration. For example, U.S. Pat. No. 6,422,001 to Sherman et al ("the '001 patent"), which issued on Jul. 23, 2002, describes a method to regenerate particulate filters by adjusting the engine parameters to increase the exhaust temperature. In this method, when the back pressure in the filter reaches a predetermined threshold, the engine speed is decreased and load on the engine is increased. This causes the temperature of the exhaust stream emanating from the engine to increase and, in response, the temperature of the filter may increase. This increase in the filter temperature purportedly aids in regenerating the filter.

While the method of the '001 patent may be used to regenerate an exhaust system element, the method has several shortcomings. The system may be unable to regenerate an exhaust element efficiently because, at times, there may not be sufficient power available for efficient regeneration. Additionally, the system may be unable to regenerate at a time when regeneration is needed because there may not be adequate power available for regeneration. Additionally, the system lacks a capability to calculate the amount of power required to regenerate the exhaust element, to determine how much power is already available for regeneration, or to generate any additional power needed for an efficient regeneration of the exhaust element.

The present disclosure is directed to overcoming one or more of the problems associated with the prior art regeneration method.

SUMMARY OF THE INVENTION

One aspect of the present disclosure includes a regeneration system for an exhaust element. The regeneration system may include a power source configured to provide a variable power output. The regeneration system may also include at least one regeneration device operably connected to the power source and adapted to use at least a portion of the variable power output to regenerate the exhaust element. A controller may be configured to determine an amount of power required to regenerate the exhaust element. The controller may also be configured to adjust operation of the power source based on the amount of power required to regenerate the exhaust element.

Another aspect of the present disclosure includes a method for controlling regeneration of an exhaust element. The method may include flowing an exhaust stream through the exhaust element. The method may also include determining an amount of power required for regeneration of the exhaust element. The method may also include adjusting at least one operational parameter of a power source based on the amount of power required for regeneration.

Another aspect of the present disclosure includes a work machine. The work machine may include an engine that generates a variable power output and an exhaust stream. The work machine may also include an exhaust conduit configured to receive and carry the exhaust stream. The work machine may also include a particulate trap operably connected to the exhaust conduit such that at least a portion of the exhaust stream flows through the particulate trap. The work machine may include a regeneration device operably connected to the particulate trap. The work machine may include a controller configured to determine an amount of power required for regeneration of the particulate trap. The controller may also be configured to determine an amount of power available for regeneration. The controller may be further configured to increase the power output of the engine if the amount of power required for regeneration exceeds the amount of power available for regeneration.

DETAILED DESCRIPTION

Figure 1:
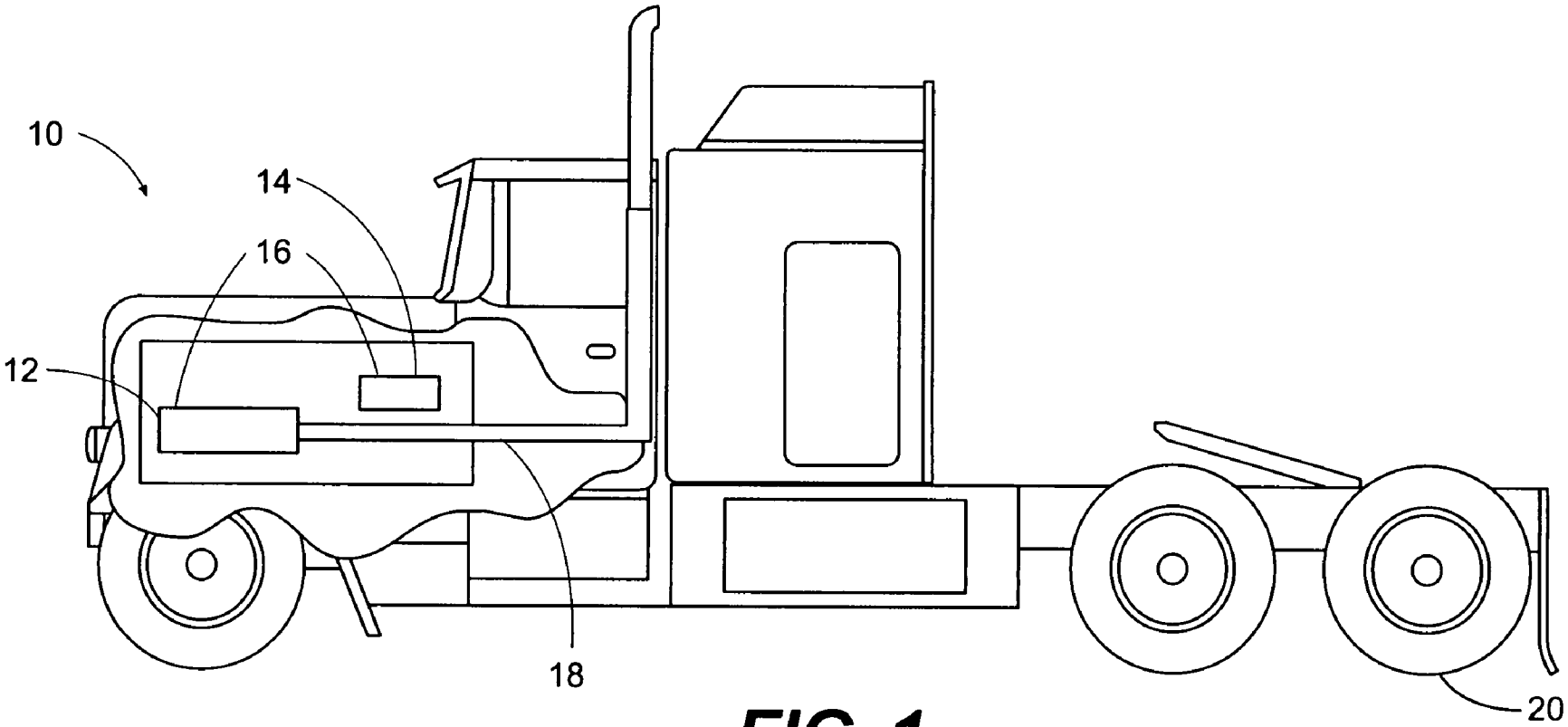
FIG. 1 is a pictorial representation of a work machine according to an exemplary disclosed embodiment.

FIG. 1 provides a pictorial illustration of work machine 10. Work machine 10 may include a power source 16 for supplying power to various components on work machine 10. Power source 16 may include an engine 12, and/or a power bus 14. Engine 12 may be operably connected to an exhaust system 18.

While work machine 10 is shown as a truck, work machine 10 may include various types of machines. For example, work machine 10 may be a track type tractor, wheeled tractor, dump truck, automobile, on-highway vehicle, off-highway vehicle, skid-steer, stationary generator, or any other device that generates an exhaust stream.

Power source 16 (e.g., engine 12 or power bus 14) may include any type of power source arranged to provide power to one or more components of work machine 10. For example, power source 16 may supply drive power to one or more traction devices 20, a power take off device (not shown), electrical components, or any other appropriate type of system. In certain embodiments, power source 16 may be used to provide power for regeneration of one or more components of exhaust system 18.

Engine 12 may include a diesel engine, a gasoline engine, an electric motor, a fuel cell or any other power-producing device. Power bus 14 may be used to distribute power for various purposes including regeneration. Specifically, power bus 14 may carry electrical power from various electrical power producing/storage devices to any device that needs power for regeneration. Power bus 14 may be made with material that may conduct electricity. Such a material may be able to transfer electric power. For example, aluminum or copper may be used to make power bus 14. While aluminum or copper may be used to construct power bus 14, other conductive materials known in the art may be used to construct power bus 14.

Exhaust system 18 may include components used to transfer exhaust produced by an engine or other device from the engine to the atmosphere. For example, exhaust system 18 may include an exhaust manifold, a particulate filter or any other filtration device, a catalytic converter or any other catalytic device, a muffler, and a tailpipe (not shown).

Figure 2:
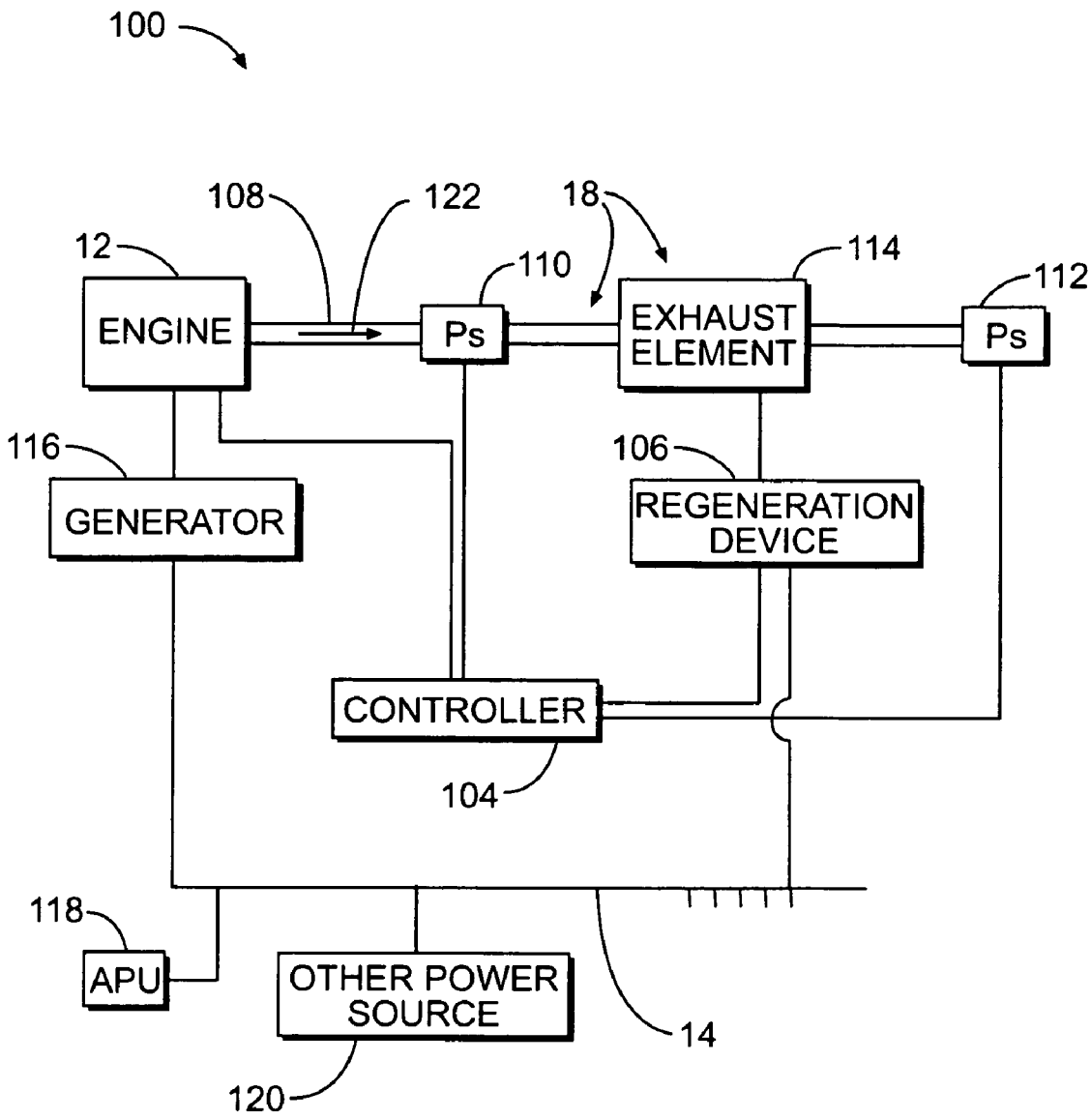
FIG. 2 is block diagram of a regeneration system according to an exemplary disclosed embodiment.

FIG. 2 provides a block diagram representation of regeneration system 100 according to an exemplary disclosed embodiment. Regeneration system 100 may include engine 12, power bus 14, a controller 104, a regeneration device 106 and an exhaust conduit 108. Regeneration system 100 may further include, pressure sensors 110 and 112. A generator 116, auxiliary power unit ("APU") 118 and any other power source 120 may be connected to power bus 14. Other power source 120 may include one or more batteries. Exhaust conduit 108 carries exhaust stream 122.

Exhaust conduit 108 may be used to transfer exhaust stream 122 from engine 12 to an exhaust element 114. Exhaust conduit 108 may include pipes or other components that facilitate the movement of exhaust stream 122 from engine 12 to exhaust element 114.

Exhaust element 114 may include any device (e.g., a particulate trap) that traps particulate matter carried by exhaust stream 122 generated by engine 12. Exhaust element 114 may include any type of structure suitable for trapping particulates in exhaust stream 122. In one embodiment, exhaust element 114 may include a porous ceramic structure that may be configured to trap particulate matter contained in exhaust stream 122. In another embodiment, exhaust element 114 may use a mesh configured to trap particulate matter contained in exhaust stream 122.

Figure 3:
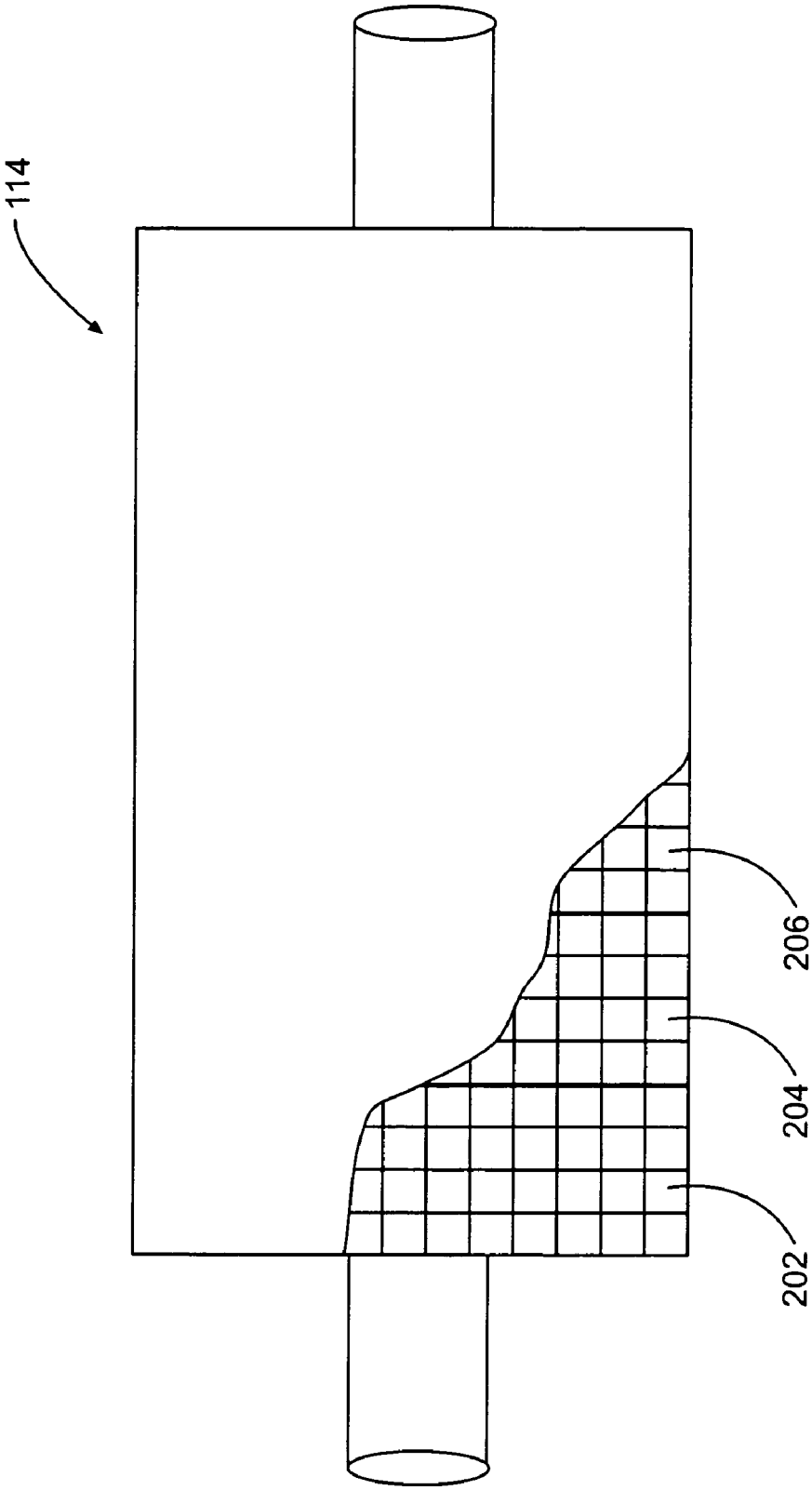
FIG. 3 is a diagrammatic illustration of an exhaust element according to an exemplary disclosed embodiment.

FIG. 3 is a diagrammatic illustration of an exhaust element according to the exemplary disclosed embodiment. Exhaust element 114 may include one or more filter sections. For example, as shown in FIG. 3, exhaust element 114 includes filter sections 202, 204 and 206. Each filter section 202, 204 and 206 may be individually regenerable. Various mechanisms may be used to regenerate each filter section individually or in a group. For example, a valve assembly (not shown) may be used to selectively block exhaust stream 122 from flowing into one or more of filter sections 202 or 204 or 206. Regeneration device 106 may be configured to regenerate some or all of filter sections 202, 204, and 206 from which stream 122 has been blocked. While only three filter sections 202, 204, and 206 are discussed here, it should be noted that exhaust element 114 may include any number of filters sections.

In one embodiment, each filter section may include a wire mesh to trap particulate matter carried by exhaust stream 122. The wire mesh may be made of various kinds of material. In one exemplary embodiment, the wire mesh may be made of material that conducts electricity. If the wire mesh is capable of conducting electricity, current may be passed through the mesh. Consequently, heat dissipated by the mesh due to the resistance provided by it may be used to heat the particulate matter trapped in the mesh.

Returning to FIG. 2, the time to start and stop regeneration may be based on the observed pressure drop across exhaust element 114. Pressure sensors 110 and 112 may be used to determine the pressure drop across exhaust element 114. Various types of pressure sensors known in the art may be used in regeneration system 100. For example, pressure sensors 110 and 112 may include differential pressure sensors or gage pressure sensors. Pressure sensors 110 and 112 may be placed in any desired location on work machine 10. In the exemplary embodiment, as shown in FIG. 2, pressure sensor 110 may be placed upstream, and pressure sensor 112 may be placed downstream of exhaust element 114. The difference between the pressure measured by pressure sensors 110 and 112 may be used to determine an observed pressure drop across exhaust element 114.

Regeneration device 106 may be used to regenerate exhaust element 114 and may include any type of device capable of converting power to heat sufficient for regeneration of at least a portion of exhaust element 114. For example, a heat exchanger, a burner, or a resistive element may be used as regeneration device 106. In the exemplary embodiment, one or more resistive heating elements may be included in regeneration device 106. Variable power provided to the resistive heating element from power bus 14 may be used to heat the element. The heat dissipated by the resistive heating element may be used for the regeneration of exhaust element 114. Specifically, heat dissipated from the resistive heating element may raise the temperature of the particulate matter accumulated in exhaust element 114 to a temperature at which the particulate matter combusts or vaporizes. For purposes of this disclosure, power includes the power used to increase the temperature of the accumulated particulate matter in exhaust element 114 and any energy capable of being converted to power for increasing the temperature of the accumulated particulate matter in exhaust element 114.

Power bus 14 may be used to supply power to regeneration device 106 for regeneration of exhaust element 114. Various electrical power sources/power storage devices may be connected to power bus 14. For example, generator 116, APU 118 or any other power source 120 (e.g. one or more batteries) may be connected to power bus 14.

Generator 116 may be connected to engine 12 and may convert mechanical energy received from engine 12 to electrical energy. As the speed of engine 12 is varied, the mechanical energy input to generator 116 may also vary. Therefore, the amount of electrical power generated by generator 116 can be variable. The amount of electrical power on power bus 14 that is supplied by generator 116 and is available for regeneration may be adjusted. Engine 12 may be configured to provide variable power output for regeneration of exhaust element 114. The variable power output of engine 12 may be related to the speed of engine 12. As the engine speed is increased, engine 12 may generate additional power. This additional power may be provided to regeneration device 106. Thus, at least a portion of this additional power may be used for regeneration.

In addition or alternatively, power from APU 118 may be supplied to power bus 14. APU 18 may be a combination of a small diesel engine with a generator or a fuel cell generator. In one embodiment, APU 118 may be used to generate electrical power when engine 12 is operating at low speeds or when engine 12 is not running. The use of APU 118 for regeneration may depend on the power needed for regeneration of exhaust element 114. APU 118 may be enabled or disabled to provide power to power bus 14 with the help of one or more electronically controlled elements (not shown). Electrical power generated by APU 118 may be transferred to regeneration device 106 by power bus 14.

In addition, any other power source 120 may be connected to power bus 14 in order to provide power to regeneration device 106. For example, one or more batteries may be connected to power bus 14. The number of batteries connected to power bus 14 may be adjusted with the aid of a switch (not shown) depending on the amount of power required for regeneration of exhaust element 114.

Controller 104 may include devices suitable for running a software application. For example, controller 104 may include a CPU, RAM, I/O modules etc. In one embodiment, controller 104 may constitute a unit dedicated to controlling the regeneration of exhaust element 114. Alternatively, controller 104 may be integrated with and/or correspond to an electronic control unit (ECU) of work machine 10.

Controller 104 may serve to control the operations of various components of work machine 10. In one embodiment, controller 104 may be configured to control the operation of regeneration device 106. For example, controller 104 may serve to determine the time to start the regeneration process. At that time, controller 104 may enable the operation of regeneration device 106. Further, controller 104 may serve to determine the time to stop the regeneration process. At that time, controller 104 may disable the operation of regeneration device 106. Controller 104 may be configured to control the operation of regeneration device 106 with the help of one or more electronically controlled elements (not shown).

Controller 104 may also be used to adjust the power output of power source 16. Specifically, controller 104 may be configured to ensure that the power needed for regeneration of exhaust element 114 is made available during the regeneration process.

Controller 104 may be configured to determine the time to commence and the time to cease regeneration based on one or more operating conditions of the engine and one or more characteristics associated with the exhaust element. For example, the time to commence regeneration and the regeneration duration may be based on the pressure drop across exhaust element 114 or the particulate matter accumulation in exhaust element 114.

Controller 104 may be configured to initiate regeneration of exhaust element 114 when the observed pressure drop across exhaust element 114 exceeds an estimated pressure drop. It should be noted that the estimated pressure drop is the expected pressure drop that is calculated when one or more operating conditions of engine 12 and one or more characteristics associated with exhaust element 114 are known. Controller 104 may be configured to receive output signals from pressure sensors 110 and 112 indicative of an observed pressure drop across exhaust element 114. The estimated pressure drop may be determined based on one or more engine operating conditions of engine 12 and one or more characteristics associated with exhaust element 114. For example, the estimated pressure drop ΔP may be obtained from the following equation:

$$\Delta P = \frac{6\mu LQ[2(e^{\gamma}+1)+\gamma(e^{\gamma}-1)]}{NH^4\gamma(e^{\gamma}-1)} \quad [1]$$

where L=length of filter sections 202, 204 and 206, Q=volumetric flow rate of the exhaust from engine 12, N=number of filter sections, H=width of each filter section 202, 204 and 206, μ is the dynamic viscosity of the gas, and $$\gamma = \sqrt{\frac{48k_0L^2}{wH^3}} \quad [2]$$

where w is the wall thickness of filter section 202, 204 and 206, and $k_0$ is the wall permeability of filter section 202, 204 and 206. It should be noted that while equation [1] represents one method for determining the estimated pressure drop across exhaust element 114, any other suitable equation may also be used.

Controller 104 may control regeneration based on a comparison of the estimated pressure drop and the observed pressure drop across element 114. If the estimated pressure drop is less than the observed pressure drop, it may indicate that the accumulation of particulate matter in exhaust element 114 has reached such a level that additional accumulation of particulate matter will affect the performance of engine 12. Controller 104 may initiate regeneration of exhaust element 114, for example, when the estimated pressure drop, ΔP, is less than the observed pressure drop across exhaust element 114.

Controller 104 may also be configured to stop regeneration of exhaust element 114 when, for example, the estimated pressure drop exceeds the observed pressure drop across exhaust element 104. For example, when the estimated pressure drop ΔP is greater than the observed pressure drop obtained from pressure sensors 110 and 112, controller 104 may be configured to stop the regeneration of exhaust element 114.

Alternatively, controller 104 may be configured to initiate and cease regeneration of exhaust element 114 based on the particulate matter accumulated in exhaust element 114. Controller 104 may be configured to determine an estimated particulate matter accumulation level in exhaust element 114 based on one or more operating conditions of engine 12 and one or more characteristics associated with exhaust element 114. It should be noted that the estimated particulate matter accumulation level in exhaust element 114 is the expected particulate matter accumulation level that is calculated when one or more operating conditions of engine 12 and one or more characteristics associated with exhaust element 114 are known. For example, the particulate matter accumulated in exhaust element 114 during any time period (Δt) may be estimated using the following equation:

$$m(\Delta t) = m_0 + \int_{\xi=t_2}^{\xi=t_1} [\eta(\xi)\cdot C_{in}(\xi)\cdot Q(\xi)\cdot \exp(-RR_0(\xi)\cdot\xi)]\,d\xi \quad [3]$$

where $m_0$ is the mass of the particulate matter present in exhaust element 114 at $t=t_1$, and the integration limits $t_1$ and $t_2$ are related to the time period $\Delta t$, $\eta$ is the filtration efficiency of the exhaust element, $\xi$ is the porosity of the filter sections in exhaust element 114, $C_{in}$ is the concentration of particulate matter in the exhaust upstream of exhaust element 114, Q is the exhaust volumetric flow rate, and $RR_0$ is the overall reaction rate of combustion in the engine. It should be noted that while equation [3] is one method for calculating the particulate matter accumulation in exhaust element 114, any other suitable equations may be used for calculating an amount of particulate matter accumulated in exhaust element 114.

Using equation [3], controller 104 may be configured to initiate regeneration of exhaust element 114 when the estimated particulate matter accumulation level, ($m(\Delta t)$), in exhaust element 114 exceeds a predetermined maximum threshold value. Controller 104 may also be configured to stop regeneration when the estimated particulate matter accumulation level in the exhaust element falls below a predetermined minimum threshold value. The maximum threshold value may correspond to a value at which the amount of particulate matter accumulated in exhaust element is such that the performance of engine 12 may be impaired. Similarly, the minimum threshold value may correspond to a value at which the amount of particulate matter accumulated in exhaust element is such that the performance of engine 12 may no longer be impaired.

In addition to determining when to initiate regeneration of element 114, controller 104 may be configured to determine any additional amount of power that may be required to regenerate element 114. In order to do this, controller 104 may be configured to determine the amount of power required for regeneration of exhaust element 114. Controller 104 may be further configured to determine the power available for regeneration. If the amount of power required to regenerate exhaust element 114 exceeds the amount of power available, controller 104 may adjust the operation of power source 16 to make up for the difference between the amount of power available and the amount of power required for regeneration of exhaust element 114.

The total power required for regeneration of exhaust element 114 may be based on the number of filter sections 202, 204 and 206 to be regenerated. The number of filter sections to be regenerated can be determined based on one or more characteristics of exhaust element 114, the one or more operating characteristics being selected from a group including an estimated pressure drop ($\Delta p$) across exhaust element 114 and an estimated particulate matter accumulation level ($\Delta m(t)$) in the exhaust element. The pressure drop $\Delta p$ may be calculated using equation [1]. The particulate matter accumulation $\Delta m(t)$ may also be calculated using equation [3]. Controller 104 may access data that indicates the number of filter sections that need to be generated based on the pressure drop ($\Delta p$) across exhaust element 114. This data may be obtained from lab tests which determine the number of filter sections 202, 204 and 206 that need to be regenerated for a given pressure drop. Alternatively, controller 104 may access data that indicates the number of filter sections that need to be generated based on the particulate matter accumulation $\Delta m(t)$ in exhaust element 114. This data may also be obtained from lab tests which determine the number of filter sections 202, 204 and 206 that need to be regenerated for a given particulate matter accumulation.

Controller 104 may be configured to determine the total power required for regeneration of exhaust element 114 based on the number of filter sections to be regenerated and the amount of power required to regenerate each filter section. The power required for the regeneration of each filter section 202, 204, 206, etc. may be determined based on the mechanism used for regeneration. For example, each mechanism may have an associated regeneration temperature and the power required for regeneration may be determined based on this temperature.

Alternatively, if the mass flow rate of the exhaust from engine 12 is known, the energy required to regenerate filter sections 202, 204 and 206 may be determined by the following energy balance equation:

$$E_r = Q_m C_p [T_r - T_c] \quad [4]$$

where $E_r$ is the energy required for regeneration, $Q_m$ is the mass flow rate of the exhaust, $C_p$ is the specific heat of the particulate matter, $T_r$ is the temperature at which regeneration occurs, and $T_c$ is the current temperature of the filter section Controller 104 may be configured to determine an amount of power available for regeneration of exhaust element 114 by determining a difference between an amount of power generated by power source 16 and a load on power source 16. The power generated by power source 16 may be determined based on engine operating conditions and specifications of power source 16. In one embodiment, where power source 16 includes engine 12, controller 104 may be configured to determine a maximum available horsepower for engine 12 based on a given engine speed. Controller 104 may access this data from the horsepower curve of engine 12. The horsepower curve of engine 12 predicts the horsepower generated by engine 12 for a given engine speed.

Controller 104 may be further configured to determine the load on engine 12. Several factors may combine to produce a load on the engine. For example, work implement operation, operating traction devices (to move the machine), heating/cooling systems, auxiliary systems including on-board electronics etc. may all combine to produce a load on engine 12. In one embodiment, a torque measuring device may be used to measure the load on engine 12. Controller 104 may be configured to determine the portion of power generated by engine 12 that is used to handle the load on engine 12 at a given speed. Controller 104 may obtain this information, for example, by accessing data that shows the amount of horsepower used for a given load on engine 12. Controller 104 may determine the difference between the power generated by engine 12 and the power used to handle the load on engine 12 to determine the amount of power available from engine 12 for regeneration of exhaust element 114.

In another embodiment, the rating of the different power producing devices connected to power bus 14 (e.g., generator 116, APU 118, other power source 120) may be used to determine the power-supplying capacity of power bus 14. For example, if a battery (not shown) is connected to power bus 14, the specific energy or power rating of the battery may be used by controller 104 to determine the maximum power that may be generated by the battery on power bus 14. Alternatively, if APU 18 is available as a power source on power bus 14, the amp-hour rating of APU 18 may be used by controller 104 to determine the power capable of being generated by APU 18.

Controller 104 may be further configured to determine the load on power bus 14. This load may include the power required for on-board electronics, on-board lighting, starting the engine etc. The load on power bus 14 may be determined by observing the load on the different power producing devices connected to power bus 14 (e.g., generator 116, APU 118, other power source 120). For example, the load on the battery may be determined by observing the current drawn from the battery at a given time. From the current drawn from the battery, controller 104 may be configured to determine the power required from the battery to handle this load. Controller 104 may be configured to determine the difference between the total capacity of the battery and the load on the battery to determine the amount of power available from the battery on power bus 14 for regeneration of exhaust element 114.

Controller 104 may be configured to adjust power source 16 if the amount of power required to regenerate exhaust element 114 exceeds the amount of power available for regeneration. For example, controller 104 may be configured to adjust the operating speed of engine 12 to vary the power output and hence adjust the amount of power available for regenerating exhaust element 114. Data made available from the horsepower curve of engine 12 may be used by controller 104 to determine the speed at which engine 12 may generate the additional power needed for regeneration of exhaust element 114. Controller 104 may be configured to adjust the speed of engine 12 such that it increases the power generated. This additional power may be made available to regeneration device 106 for the regeneration of exhaust element 114.

Alternatively, controller 104 may also adjust the power available on power bus 14, for example, by increasing the number of power producing devices that may be connected to it. For example, controller 104 may add multiple APUs to the power bus. Alternatively or additionally, controller 104 may add additional batteries (not shown) to power bus 14. Controller 104 may add these additional power sources by means of one or more electronically controlled elements (not shown).

Controller 104 may be configured to calculate a regeneration efficiency value. Calculation of the regeneration efficiency value is based on determining the amount of particulate matter accumulated in exhaust element 114 and an amount of particulate matter left in exhaust element 114 after regeneration. For example, the amount of particulate matter accumulating in exhaust element 114 may be determined by equation [3]. The particulate matter left in exhaust element 114 after its regeneration is complete may be based on the difference between the particulate matter accumulated in exhaust element 114 and the amount of particulate matter oxidized during regeneration. The amount of particulate matter oxidized during regeneration of exhaust element 114 may be determined based on the chemical kinetics of the technology used for regeneration. For example if a resistive heating element is used as regeneration device 106, the oxidization reaction rate may be obtained by equations known in the art (e.g. the Arrhenius equation).

INDUSTRIAL APPLICABILITY

The disclosed regeneration system may be adapted for use in any system that could benefit from regeneration of an exhaust element. By calculating the amount of power required for regeneration and adjusting a power source to provide the additional power required for regeneration, the disclosed regeneration system may offer a more efficient method for regeneration than those available in the prior art.

Use of the disclosed regeneration system may reduce the regeneration duration of an exhaust element because the requisite amount of power for regeneration is made available by the system. If the amount of power needed for regeneration is not available, the regeneration duration may be longer than necessary. The disclosed regeneration system, however, may be configured to generate the amount of additional power needed for regeneration. Thus, the regeneration duration is no longer than necessary. The performance of the engine of a work machine may be reduced during regeneration. Therefore, reducing the regeneration duration can increase or preserve the performance of the engine.

In addition, because of the capability of generating additional power for regeneration, the disclosed system may aid the work machine in initiating the regeneration process whenever regeneration is needed rather than regenerating only when enough power is available. Furthermore, because of the increased efficiency of the regeneration process due to the use of the disclosed system, the possibility of exhaust element failure is reduced. The reduction in the failure rate of the exhaust element may reduce maintenance costs associated with the work machine.

It will be apparent to those skilled in the art that various modifications and variations can be made in the disclosed regeneration system without departing from the scope of the disclosure. Additionally, other embodiments of the disclosed system will be apparent to those skilled in the art from consideration of the specification. It is intended that the specification and the examples be considered exemplary only, with a true scope of the disclosure being indicated by the following claims and their equivalents.

What is claimed is:

1. A method of controlling regeneration of an exhaust element, comprising:

flowing an exhaust stream through the exhaust element;

determining an amount of power required for regeneration of the exhaust element; and adjusting at least one operational parameter of a power source based on the amount of power required for regeneration.

2. The method of claim 1, wherein adjusting at least one operational parameter of the power source includes adjusting an operating speed of the power source.

3. The method of claim 1, further including:

determining an amount of power available for regeneration by calculating a difference between an amount of power generated by the power source and a load on the power source;

increasing an operating speed of the power source if the amount of power required for regeneration exceeds the amount of power available for regeneration; and initiating regeneration of the exhaust element.

4. The method of claim 1, wherein the exhaust element includes a plurality of separately regenerable filter sections, and determining the amount of power required for regeneration of the exhaust element includes determining a number of filter sections to be regenerated.

5. The method of claim 4, further including:

estimating a pressure drop across the exhaust element;

estimating a particulate matter accumulation level in the exhaust element; and wherein determining the number of filter sections to be regenerated is based on at least one of the estimated pressure drop and the estimated particulate matter accumulation level.

6. The method of claim 1, further including:

estimating a pressure drop across the exhaust element;

estimating a particulate matter accumulation level in the exhaust element;

determining an observed pressure drop across the exhaust element; and initiating regeneration of the exhaust element if the estimated pressure drop is less than the observed pressure drop or the estimated particulate matter accumulation level in the exhaust element exceeds a predetermined threshold value.

7. The method of claim 6, further including ceasing regeneration of the exhaust element when the estimated pressure drop is more than the measured pressure drop or the estimated particulate matter accumulation level falls below a predetermined particulate matter threshold value.

8. A regeneration system for an exhaust element comprising:

a power source configured to provide a variable power output;

at least one regeneration device operably connected to the power source and adapted to use at least a portion of the variable power output to regenerate the exhaust element; and a controller configured to:

determine an amount of power required to regenerate the exhaust element; and adjust operation of the power source based on the amount of power required to regenerate the exhaust element.

9. The regeneration system of claim 8, wherein the exhaust element includes a particulate trap.

10. The regeneration system of claim 8, wherein the controller is configured to adjust an operating speed of the power source to vary the power output and an amount of power available for regenerating the exhaust element.

11. The regeneration system of claim 8, wherein the power source includes an engine.

12. The regeneration system of claim 8, wherein the at least one regeneration device includes one or more resistive heating elements.

13. The regeneration system of claim 8, wherein the exhaust element includes a plurality of filter sections, and the controller is configured to:

determine a number of filter sections to be regenerated; and determine the amount of power required to regenerate the exhaust element based on the number of filter sections to be regenerated.

14. The regeneration system of claim 13, wherein the number of filter sections to be regenerated is determined based on one or more operating characteristics of the exhaust element, the one or more operating characteristics being selected from a group including an estimated pressure drop across the exhaust element and an expected particulate matter accumulation level in the exhaust element.

15. The regeneration system of claim 8, wherein the controller is configured to determine an amount of power available for regeneration of the exhaust element by determining a difference between an amount of power generated by the power source and a load on the power source.

16. The regeneration system of claim 15, wherein controller is configured to:

adjust the operation of the power source if the amount of power required to regenerate the exhaust system exceeds the amount of power available for regeneration; and initiate regeneration of the exhaust element.

17. The regeneration system of claim 8, wherein the controller is further configured to calculate a regeneration efficiency value.

18. The regeneration system of claim 17, wherein calculation of the regeneration efficiency value further includes estimating an amount of particulate matter accumulated in the exhaust element and an amount of particulate matter left in the exhaust element after regeneration.

19. The regeneration system of claim 8, wherein power source includes an engine that generates an exhaust stream supplied to the exhaust element, and the controller is further configured to determine an estimated pressure drop and an estimated particulate matter accumulation level in the exhaust element based on one or more operating conditions of the engine and one or more characteristics associated with the exhaust element.

20. The regeneration system of claim 19, further including at least one pressure sensitive component configured to provide an output indicative of an observed pressure drop across the exhaust element, and wherein the controller is further configured to initiate regeneration of the exhaust element when the estimated pressure drop is less than the observed pressure drop across the exhaust element or when the estimated particulate matter accumulation level in the exhaust element exceeds a predetermined threshold value.

21. The regeneration system of claim 20, wherein the controller is further configured to stop regeneration of the exhaust element when the estimated pressure drop exceeds the observed pressure drop across the exhaust element or when the estimated particulate matter accumulation level in the exhaust element falls below the predetermined threshold value.

22. A machine comprising:

an engine that generates a variable power output and an exhaust stream;

an exhaust conduit configured to receive and carry the exhaust stream;

a particulate trap operably connected to the exhaust conduit such that at least a portion of the exhaust stream flows through the particulate trap;

a regeneration device operably connected to the particulate trap; and a controller configured to:

determine an amount of power required for regeneration of the particulate trap;

determine an amount of power available for regeneration; and increase the power output of the engine if the amount of power required for regeneration exceeds the amount of power available for regeneration.

23. The machine of claim 22, wherein the particulate trap includes a plurality of separately regenerable filter sections, and wherein the amount of power required for regeneration of the particulate trap is determined based on a total number of filter sections to be regenerated.

24. The machine of claim 22, wherein the amount of power available for regeneration is determined based on a difference between an amount of power generated by the engine and a load on the engine.

25. The machine of claim 22, wherein the power output of the engine is increased by increasing a speed of the engine.

* * * * *